US007013810B1

(12) United States Patent
Brydges-Price

(10) Patent No.: US 7,013,810 B1
(45) Date of Patent: Mar. 21, 2006

(54) PROJECTILE FOR DELIVERY OF A TRANQUILLISER

(76) Inventor: Richard Ian Brydges-Price, Newton of Stracathro By Brechin, Angus Tayside (GB) DD97QQ ( * ) Notice: Subject to any disclaimer, the term of this patent is extended or adjusted under 35 U.S.C. 154(b) by 0 days.

(21) Appl. No.: 09/979,356

(22) PCT Filed: May 23, 2000

(86) PCT No.: PCT/GB00/01973

§ 371 (c)(1),
(2), (4) Date: Nov. 21, 2001

(87) PCT Pub. No.: WO00/71967

PCT Pub. Date: Nov. 30, 2000

(30) Foreign Application Priority Data

May 24, 1999 (GB) ..... 9912070

(51) Int. Cl.
*F42B 12/54* (2006.01)
*F42B 12/34* (2006.01)

(52) U.S. Cl. ..... 102/502; 102/512

(58) Field of Classification Search ..... 102/512, 102/502, 306–307, 431; 42/78; 604/198
See application file for complete search history.

(56) References Cited

U.S. PATENT DOCUMENTS 1,366,039 A * 1/1921 Cartwright ..... 102/512
2,854,925 A * 10/1958 Crockford et al. ..... 102/512
3,386,381 A * 6/1968 Ferb ..... 102/502
3,502,025 A 3/1970 Payne
3,528,662 A * 9/1970 Engle et al. ..... 473/577
3,565,435 A * 2/1971 Bear ..... 102/512
3,584,582 A 6/1971 Muller
3,701,533 A * 10/1972 Palmer ..... 102/512
3,732,821 A * 5/1973 Royer ..... 102/431
3,820,465 A 6/1974 Delphia
3,901,158 A * 8/1975 Ferb ..... 102/512
4,243,036 A 1/1981 Ott
4,898,589 A * 2/1990 Dolgin et al. ..... 604/198
4,950,250 A * 8/1990 Haber et al. ..... 604/198
5,221,809 A * 6/1993 Cuadros ..... 102/502
H1365 H * 11/1994 Amspacker et al. ..... 42/78
5,649,466 A * 7/1997 Genovese ..... 89/1.11

(Continued)

FOREIGN PATENT DOCUMENTS

DE 2018191 11/1971

(Continued)

*Primary Examiner*—Michael J. Carone
*Assistant Examiner*—James S. Bergin
(74) *Attorney, Agent, or Firm*—Horst M. Kasper

(57) ABSTRACT

A projectile mainly for drug delivery comprises a tubular body casing 1 which defines a cavity 2 for containment of a tranquilizing drug. The casing has an end plug 3 which coaxially supports a hollow needle 4 projecting forward through an ogival nose cap 5. The delivery end 6 of the needle 4 projects a short way beyond the cap 5. Located around the needle 4 towards the tip of the nose cap 5 is a gas producing detonator 7 fired by an impact fuse 8. Attached to the detonator 7 and the needle 4 is the neck g of an inflatable bag 10 of which an opposed end 11 is attached to the plug 3. The rear end of the cavity 2 has a piston 12 the rear end of which communicates through concentric passageways 13 and ducts 14 with the interior of the bag 10. The nose cap 5 is of a readily breakable plastics material or designed to assist retardation.

33 Claims, 2 Drawing Sheets

U.S. PATENT DOCUMENTS

Figure 1:
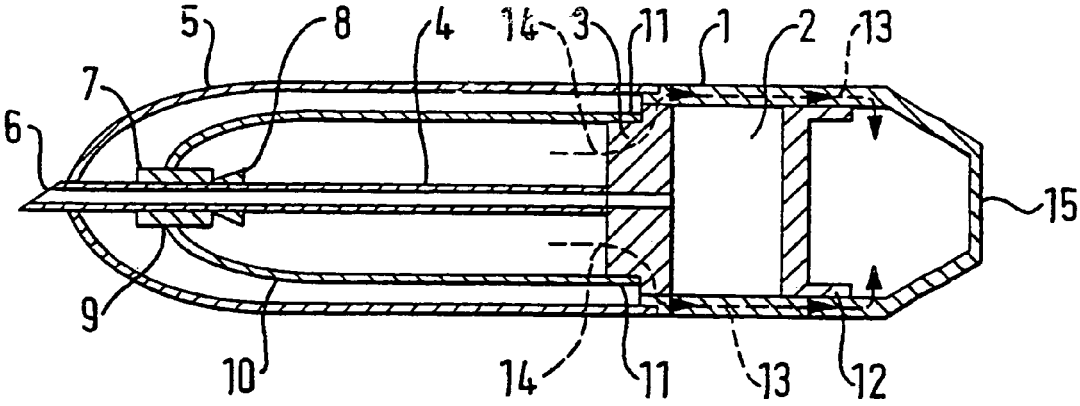

| | | | | | |
|---|---|---|---|---|---|
| 5,792,976 | A | * | 8/1998 | Genovese | 102/293 |
| 6,298,787 | B1 | * | 10/2001 | Warnagiris | 102/502 |
| 6,640,721 | B1 | * | 11/2003 | Standback et al. | 102/401 |
| 6,892,983 | B1 | * | 5/2005 | Kneisl | 244/118.5 |

FOREIGN PATENT DOCUMENTS

| | | | | | |
|---|---|---|---|---|---|
| DE | 2018191 | A | | 11/1971 | |
| DE | 2260529 | | | 6/1974 | |
| DE | 2260529 | A | | 6/1974 | |
| EP | 0618421 | A1 | * | 5/1994 | 102/512 |
| EP | 0618421 | A | | 10/1994 | |
| FR | 2561762 | | * | 9/1985 | 102/512 |
| FR | 2762081 | | | 10/1998 | |
| FR | 2762081 | A | | 10/1998 | |
| GB | 1366039 | | | 9/1974 | |
| GB | 2216240 | | * | 4/1989 | 102/512 |

* cited by examiner

PROJECTILE FOR DELIVERY OF A TRANQUILLISER

This invention relates to a projectile primarily forming a medication delivery system and is more particularly concerned with a projectile for delivering any tranquillising substance, drug, vaccine, medication, identification means or tracking device to an animal or to any other target. The system may also be used to take a sample of tissue. Such projectiles are commonly referred to as tranquilliser darts and their primary purpose is to provide means for remotely delivering and injecting a tranquillising fluid or medication into an animal without causing undue harm or stress.

There has long been a need to capture, study, relocate or medicate animals and various means are used. The most commonly used method being by means of some form of adapted syringe containing a tranquilliser which is is propelled and injected on impact into the animal. These tranquilliser dart devices have serious disadvantages primarily being lack of range and accuracy due to poor ballistic properties and the highly parabolic trajectory making range estimation critical. As a projectile the devices are inherently unstable due to length and weight and cannot be spin stabilised to any useful degree due to the low velocity which is required to avoid deep penetration which is a major factor. The known devices are also complex to assemble and load often with highly toxic drugs and are heavy in relation to the delivered payload.

It is one object of this invention to provide a tranquilliser or other medication delivery system using a projectile, being preferably spin stabilised having improved range and accuracy and of an inherently stable ballistic shape.

In accordance with this invention there is provided a projectile, primarily for the delivery of a tranquilliser or medication substance to an animal, the projectile including a cavity to contain such substance, means to deliver the said substance at a point of impact with a target, and means to effectively retard the velocity of the projectile on impact with the target.

The velocity is retarded in such a way as to prevent excess injury or penetration and may be achieved by means which rapidly produces a large increase in area at the nose of the projectile thus spreading and dissipating the kinetic energy over a large area.

Preferably the projectile is adapted to be fired from a barrel weapon which may be rifled to impart spin. The projectile may be of sub-calibre design using a discarding sabot and be fired in a barrel having progressive rifled pitch to attain a velocity greater than 500 m/s.

In one preferred construction the projectile has a body with a cavity containing a payload, such as a tranquilliser drug, an ogival nose supporting a hollow needle communicating with the cavity for delivery of the drug on deceleration of the projectile and means operative on impact of the projectile to retard the velocity. The arrangement is such that the needle penetrates just sufficiently to deliver the drug dose effectively, subcutaneously or intra-muscularly.

The velocity retarding means may comprise a device to significantly increase the area of the projectile nose portion on initial impact thus dissipating kinetic energy over a large area.

In one construction the velocity retarding means comprises an inflatable membrane actuated by a sensor on initial impact or using a proximity sensing means. The membrane may be inflated through a detonator and gas producing explosive charge. This charge may also serve for the purpose of injecting the drug by driving a piston in the drug containing cavity.

The membrane can be located in the nose of the projectile comprising a readily broken, fragmenting, unfurling or deployable cap. The membrane may be in the form of a bag attached to and around a forward end of the needle thus preventing penetration beyond a predetermined depth. The inflation or injection detonator may be attached concentrically around the needle.

The nose part of the projectile may include a solid foam-like or gel-like substance forming an impact absorbing material which spreads on impact. More specifically the gel may comprise a nano-porous open cell foam of the kind known by the trade mark Aerogel.

Figure 2:
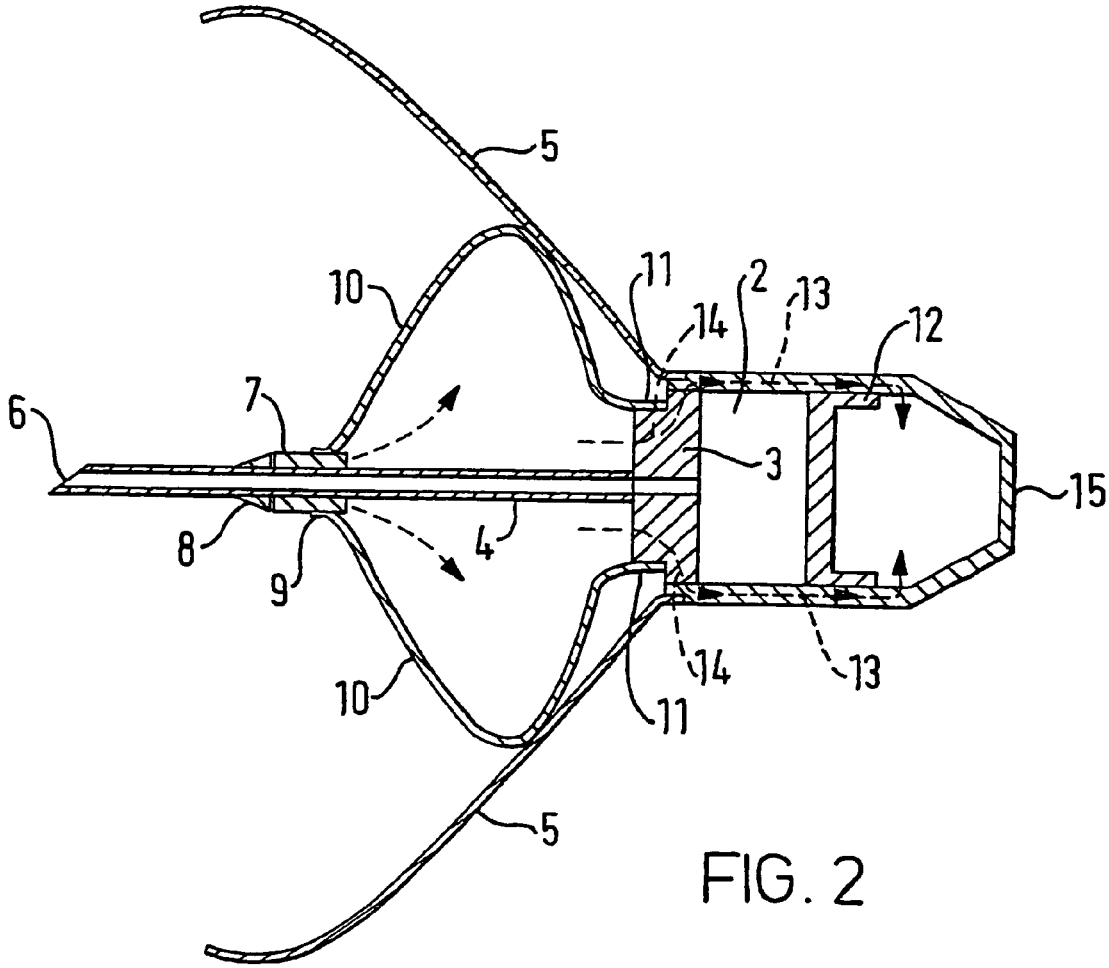
Figure 3:
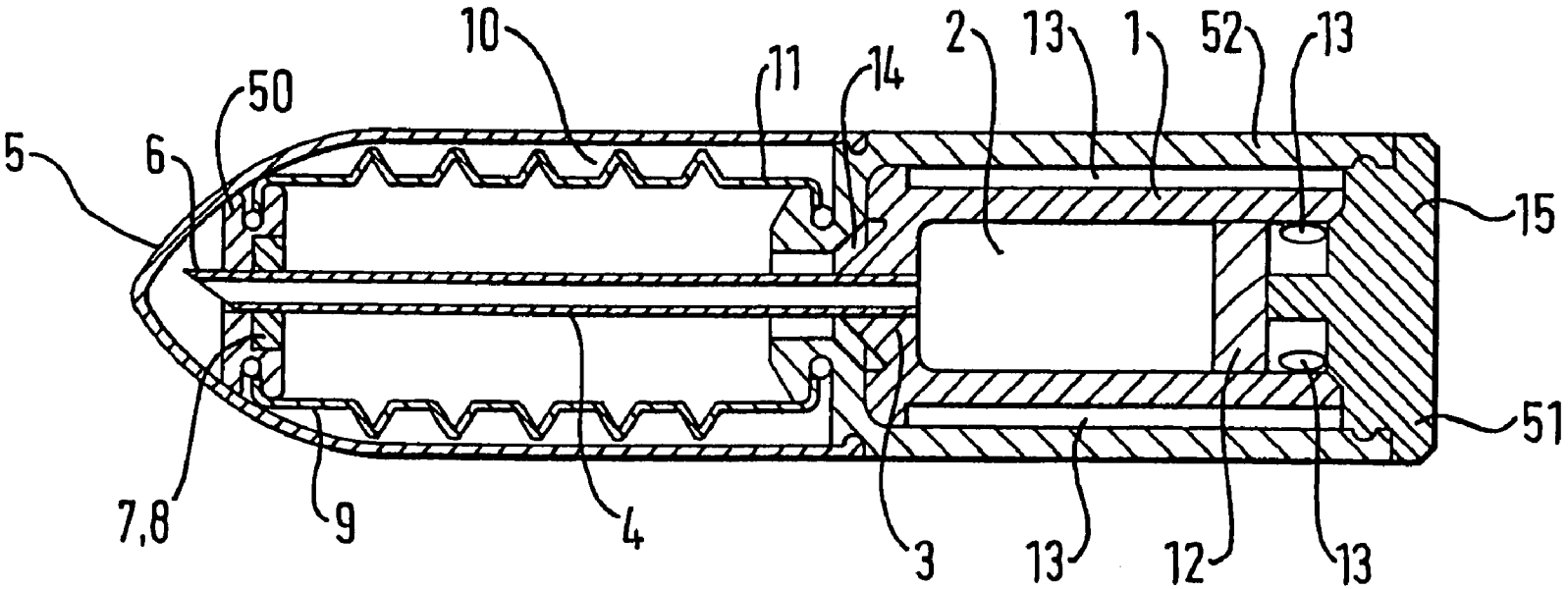

This invention is further described and illustrated with reference to the drawings showing an embodiment and a modification thereof by way of examples only. In the drawings:

FIG. 1 shows a longitudinal cross-section of a projectile in accordance with this invention, FIG. 2 shows the projectile during the target impact phase, and FIG. 3 shows a further embodiment in longitudinal cross-section.

Referring to the drawings and firstly FIG. 1 the projectile according to this invention comprises a tubular body casing 1 which defines a cavity 2 for containment of a tranquillising drug generally being a fluid. The fluid may be stabilised by means of a sponge or similar material to prevent inertia to spin which may create instability in flight. The casing has an end plug 3 which coaxially supports a hollow needle 4 projecting forward through an ogival nose cap 5. The delivery end 6 of the needle 4 projects a short way beyond the cap 5.

Located around the needle 4 towards the tip of the nose cap 5 is a gas producing detonator 7 fired by an impact fuse pin 8. In an alternative arrangement two, or more, otherwise inert substances are to be brought together to initiate an action. Attached to the detonator 7 and the needle 4 is the neck 9 of an inflatable bag 10 of which an opposed end 11 is attached to the plug 3. The rear end of the cavity 2 has a piston 12 the rear end of which communicates through concentric passageways 13 around the cavity 2 and ducts 14 in the plug 3 with the interior of the bag 10. The rear end of the casing 1 is closed off by a tail piece 15.

The projectile has an inherently stable ballistic shape and may have a mass of about 8 to 10 grammes and be some 1.5 cm in calibre. Larger or smaller calibre may be used as appropriate to the circumstances. The projectile may be embraced by a discarding sabot of plastics material and may be fired from a progressive pitch rifled barrel giving a muzzle velocity of about 500 m/s. The range under these conditions should be of the order of 150 m with a mid range trajectory fall of less than 20 cm.

The nose cap 5 is of a readily frangible plastics material and may include structural lines of weakness to facilitate fragmentation. The inflatable bag 10 may be of Kevlar material, latex or silicone as examples of suitable materials. An impact absorbing material such as Aerogel may be contained in the nose cap. A marking dye substance may also be included.

Referring to FIG. 2 In use, and following discharge from the weapon, the needle tip 6 will make initial impact and the detonator 7 is driven back along the needle from position A to position B and fired via the ignition and retention cuff forming a fixed pin assembly 8 to thus inflate the bag 10 rapidly. The bag 10 expands as illustrated in FIG. 2 and prevents excess penetration whilst spreading the impact energy over a wide area. On inflation of the bag the nose cap 5 is broken open and may be discarded. In an alternative arrangement the nose cap 5 may spread open as shown in a petaline manner and add to the retardation effect. The bag may be striated longitudinally or laterally and coated or impregnated with gas producing chemical compounds to both accelerate expansion and strengthen the bag membrane. The bag inflation gas bleeds through ducts 14 and passageways 13 to drive piston 12 forward thus delivering the drug through the needle 6.

In a modification excess gas pressure is used to further retard the projectile by forward facing discharge nozzles.

FIG. 3 shows a further embodiment in longitudinal cross-section and wherein like references indicate parts of similar function to those described in conjunction with FIGS. 1 and 2. In this embodiment the bag 10 is folded in the manner of a bellows as shown, to provide greater expansion capability, and retained at the nose, within the cap 5, by an annular support 50 holding the detonator charge. This support 50 also centralises the needle 6 and closes the nose completely. The tail piece 15 comprises a removable plug 51 to permit filling of the cavity 2. The container 1 here is a removable module carrying the needle 6 and is housed within the projectile outer case 52.

The propellant charge for the projectile may be included within an integral cartridge casing forming a single piece round. The projectile may be a single use device pre-loaded with a defined drug charge with different dosages being coded for ease of field use. The dosage may be controlled by the concentration gradient instead of by volume. In this way the trajectory remains the same simplifying aiming with different drug masses. The casing may comprise a carbon fibre material or glass bonded hydrocarbon matrix.

The dart may be packaged in such a way that arming only occurs when removed from the pack.

The projectile has a particular use for soft skin animals which presently require firing at close range typically 20 m. A smaller dart construction may be applied to birds and reptiles.

The invention claimed is:

1. A projectile, primarily for the delivery of a tranquilliser or medication substance to an animal, the projectile including a cavity to contain such substance, means to deliver the said substance at a point of impact with a target, and means to effectively retard the velocity of the projectile on impact with the target, characterised in that the velocity is retarded in such a way as to prevent excess injury or penetration by deployment of means, following impact with a target, which comprises a membrane which rapidly inflates to thus expand to produce a large increase in the area at the nose of the projectile to spread the kinetic energy over a large area.

2. A projectile in accordance with claim 1, wherein the projectile is adapted to be fired from a barrel weapon which may be rifled to impart spin.

3. A projectile in accordance with claim 1, wherein the projectile is of sub-calibre construction using a discarding sabot.

4. A projectile in accordance with claim 1, wherein the projectile has a body with a cavity containing a payload, an original nose supporting a hollow needle communicating with the cavity for delivery of the payload on deceleration of the projectile and an expanding means operative on impact of the projectile to retard the velocity.

5. A projectile in accordance with claim 4, wherein the needle penetrated just sufficiently to deliver the payload dose subcutaneously or intra-muscularly.

6. A projectile in accordance with claim 1, wherein the velocity retarding means may comprise a device to significantly increase the area of the projectile nose portion by expansion on initial impact thus dissipating kinetic energy over a large area.

7. A projectile in accordance with claim 1, constructed as a sub-calibre discarding sabot projectile.

8. A projectile in accordance with claim 1 in combination with a firearm having a barrel with rifling of increasing pitch along the length thereof to produce progressively increasing spin of the projectile during passage to through the barrel.

9. The projectile in accordance with claim 1, wherein the rapidly expanding means comprises a nose cap, an inflatable membrane, wherein the inflatable membrane is covered by the nose cap.

10. The projectile in accordance with claim 9, wherein the nose cap spreads open in a petaline manner upon impact.

11. The projectile in accordance with claim 9, wherein the nose cap fractures upon impact.

12. The projectile in accordance with claim 1, wherein the nose contains structural lines of weakness to facilitate fragmentation.

13. The projectile in accordance with claim 1, wherein the inflatable membrane comprises bellows.

14. The projectile in accordance with claim 1, wherein the rapidly expanding means is inflatable.

15. The projectile in accordance with claim 14, further comprising a gas producing detonator located around the means to deliver said expanding means.

16. The projectile in accordance with claim 15, further comprising and inflatable bag attached to the means to deliver said substance and to the detonator.

17. The projectile in accordance with claim 14, further comprising an inflatable bag attached to the means to deliver said substance and to the detonator.

18. The projectile in accordance with claim 14, further comprising means for bringing together two otherwise inert substances to initiate action of the rapidly expandable means.

19. The projectile with claim 14, wherein the velocity retarding means comprises a device to significantly increase the area of the projectile nose portion by expansion on initial impact thus dissipating kinetic energy over a large area.

20. The projectile in accordance with claim 1, further comprising a piston disposed behind the means to deliver said substance.

21. The projectile in accordance with claim 20, further comprising an inflatable bag attached to the means to deliver said substance, wherein a rear piston face communicates with an interior of the inflatable bag, and wherein a front piston face drives said substance into the means to deliver said substance.

22. A projectile primarily for the delivery of a tranquilliser or medication substance to an animal, the projectile including a cavity to contain such substance, means to deliver the said substance at a point of impact with a target, and means to effectively retard the velocity of the projectile on impact with the target, characterised in that the velocity is retarded in such a way as to prevent excess injury or penetration by deployment of means, following impact with a target, which comprises a membrane which rapidly inflates to thus expand to produce a large increase in the area at the nose of the projectile to spread the kinetic energy over a large area, wherein the velocity retarding means comprises an inflatable membrane actuated by a sensor on initial impact or by means of a proximity sensing means.

23. A projectile in accordance with claim 22, wherein the membrane is inflated using a detonator and gas producing explosive charge.

24. A projectile in accordance with claim 23, wherein the charge also serves the purpose of injecting the payload by driving a piston in the payload containing cavity.

25. A projectile in accordance with claim 23, wherein the detonator is attached concentrically around the needle.

26. A projectile in accordance with claim 23, wherein the detonator is attached concentrically around the needle.

27. A projectile in accordance with claim 22, wherein the membrane is located in the nose of the projectile which comprises a readily broken, an unfurling or deployable cap.

28. A projectile in accordance with claim 22, wherein the membrane is in the form of a bag attached to and around a forward end of the needle thus preventing penetration beyond a predetermined depth.

29. A projectile in accordance with claim 22, wherein the membrane is of an expandable material or is folded or pleated to permit expansion.

30. A projectile for a delivery of a tranquiliser or medication substance to an animal, the projectile including a tranquiliser or medication substance for an animal;

a projectile casing;

a cavity formed in the projectile casing and containing the tranquilliser or medication substance;

means to deliver the said projectile casing, having the cavity containing the tranquiliser or medication substance, to a point of impact with a target, a sensor serving as an actuator upon initial impact;

an inflatable membrane connected to the sensor and to be actuated by the sensor, wherein the sensor and the inflatable membrane form means to effectively retard the velocity of the projectile on impact with the target in such a way as to prevent excess injury or penetration;

means for producing a large increase in the area at the nose of the projectile to spread the kinetic energy over a large area upon impact with the target.

31. The projectile according to claim 30, wherein the membrane is inflated using a detonator and a gas producing explosive charge.

32. The projectile according to claim 30, wherein the membrane is inflated using gas pressure.

33. A projectile for a delivery of a tranquiliser or medication substance to an animal, the projectile including a tranquiliser or medication substance for an animal;

a projectile casing;

a cavity formed in the projectile casing and containing the tranquilliser or medication substance;

means to deliver the said projectile casing, having the cavity containing the tranquiliser or medication substance, to a point of impact with a target, a proximity sensing means serving as an actuator upon initial impact;

an inflatable membrane connected to the proximity sensing means and to be actuated by the proximity sensing means, wherein and the inflatable membrane form means to effectively retard the velocity of the projectile on impact with the target in such a way as to prevent excess injury or penetration;

means for producing rapidly a large increase in the area at the nose of the projectile to spread the kinetic energy over a large area upon impact with the target.

* * * * *